US005507653A

United States Patent [19]

Stoner

[11] Patent Number: 5,507,653

[45] Date of Patent: Apr. 16, 1996

[54] INSULATIVE WAFERS FOR INTERCONNECTING A VERTICAL RECEPTACLE TO A PRINTED CIRCUIT BOARD

[75] Inventor: Stuart C. Stoner, Lewisberry, Pa.

[73] Assignee: Berg Technology, Inc., Reno, Nev.

[21] Appl. No.: 421,042

[22] Filed: Apr. 12, 1995

Related U.S. Application Data

[63] Continuation of Ser. No. 243,116, May 16, 1994, abandoned, which is a continuation of Ser. No. 13,875, Jan. 25, 1993, abandoned.

[51] Int. Cl.[6] ..... H01R 23/72

[52] U.S. Cl. ..... 439/74; 439/381; 439/374

[58] Field of Search ..... 439/380, 381, 439/65, 74, 246, 374, 378

[56] References Cited

U.S. PATENT DOCUMENTS

| | | | |
|---|---|---|---|
| 4,417,777 | 11/1983 | Bamford | 439/381 |
| 4,954,086 | 9/1990 | Hill et al. | 439/381 |
| 4,993,965 | 2/1991 | Eck | 439/374 |
| 5,004,727 | 4/1991 | Lindeman | 439/101 |
| 5,160,272 | 11/1992 | Zell et al. | 439/101 |

*Primary Examiner*—Gary F. Paumen

*Attorney, Agent, or Firm*—Woodcock Washburn Kurtz Mackiewicz & Norris

[57] ABSTRACT

This invention relates to a connector wafer for interconnecting a vertical receptacle and a printed circuit board and a connector assembly for interconnecting parallel circuit boards. The connector wafer has an insulative block, locating pins providing for an interference fit into the printed circuit board, an attachment fork for receiving a locating pin on the vertical receptacle, passages for receiving terminal tails of the female receptacle, and standoffs providing a space between a side of the connector connector wafer and an opposing mating side of the vertical female receptacle. The connector assembly is an assembly of the connector wafer and the vertical receptacle.

16 Claims, 7 Drawing Sheets

INSULATIVE WAFERS FOR INTERCONNECTING A VERTICAL RECEPTACLE TO A PRINTED CIRCUIT BOARD

This is a continuation of application Ser. No. 08/243,116, filed May 16, 1994, now abandoned, which in turn is a continuation of Ser. No. 08/013,875, filed Jan. 25, 1993, now abandoned.

FIELD OF THE INVENTION

This invention relates to connector wafers for interconnecting vertical receptacles to printed circuit boards, and in particular, connector wafers for use with vertical receptacles of set dimensions to provide one or more desired spacings between parallel printed circuit boards.

DESCRIPTION OF RELATED ART

FIG. 1 is a perspective view of a METRAL™ assembly having a male connector or header 10 mounted on a backplane or other printed circuit board 12, a right angle female connector or receptacle 14 connected to the header 10 and having a housing 21 and a plurality of terminal tails 16, the right angle female connector or receptacle 14 mounted on a daughter card or other printed circuit board 18 which is perpendicular to the backplane 12. The connectors of the assembly of FIG. 1 are sold by E. I. du Pont de Nemours and Company under the trademark METRAL™. Such METRAL™ header and METRAL™ right angle receptacle modules are described in the Du Pont Connector Systems Product Catalog A, February 1992, Chapter 10.

In many applications it is desirable to have a vertical female connector or receptacle. Such a vertical female connector or receptacle can be attached to a male connector or header to form an assembly which can interconnect parallel printed circuit boards. Further, it is desirable to reduce the cost, design, and labor requirements associated with producing vertical female connectors or receptacles by manufacturing the vertical female connector with the same housing as that of the existing METRAL™ right angle female connector or receptacle housing 21.

An object of the present invention is to provide for a connector wafer which can be attached to a vertical female connector or receptacle produced using the existing METRAL™ right angle female connector or receptacle housing 21, to form a connector assembly which, when attached to a male connector or header can be used to interconnect parallel printed circuit boards so that the distance between the parallel printed circuit boards is of a particular dimension. For interconnecting vertical receptacles with printed circuit boards for use with the METRAL™ system, a 20 millimeter (mm) spacing requirement 72 (FIG. 4 and 5) between parallel printed circuit board assemblies is desired.

There is needed a connector wafer that can interconnect a vertical female connector or receptacle (using the existing METRAL™ right angle receptacle housing 21) to a printed circuit board, the vertical female connector or receptacle attaching to a male connector or header which can connect to a second printed circuit board, such that the desired 20 mm METRAL™ system printed circuit board to printed circuit board spacing is met.

SUMMARY OF THE INVENTION

This invention is related to a connector wafer for interconnecting a vertical receptacle to a circuit board, comprising:

an insulative block having a first side and a second side;

two locating pins extending from the second side for interference fit in holes through the circuit board, the locating pins on diagonal corners of the second side;

an attachment fork extending from the first side, the fork having a slot for receiving a locating pin on a side of the receptacle and for aligning the receptacle on the wafer;

steps extending from the first side for contacting a mating opposing side of the receptacle, passages extending through the block, each passage for receiving at least one terminal tail to extend therethrough to allow for non-contacting extension of the terminal tails through the passages; and standoffs extending from the second side for contacting the circuit board and providing a space between the printed circuit assembly and the insulative block for cleaning purposes.

Another aspect of the invention relates to a connector assembly for interconnecting parallel printed circuit boards which comprises:

a vertical female receptacle comprising an insulative housing having a mating opposing side, and an attachment side with a locating pin, passages extending through the housing terminals in the passages with terminal portions extending from the mating opposing side, the terminals having tails, and a connector wafer comprising an insulative block with a first side and a second side, two locating pins extending from the second side for interference fit in holes through the printed circuit board, the locating pins on diagonal corners of the second side, an attachment fork extending from the first side, the fork having a slot for receiving the locating pin on a side of the vertical receptacle and for aligning the receptacle on a wafer, steps extending from the first side for contacting the mating opposing side of the receptacle, passages extending through the block, each passage for receiving at least one of the terminal tails to extend therethrough to allow for non-contacting extension of the terminal tails through the passages, and standoffs extending from the second side for contacting the printed circuit board and providing a space between the printed circuit board and the insulative block for cleaning purposes.

BRIEF DESCRIPTION OF THE DRAWINGS

The invention can be more fully understood from the following detailed description thereof in connection with accompanying drawings described as follows.

DESCRIPTION OF THE PREFERRED EMBODIMENT

Figure 2:
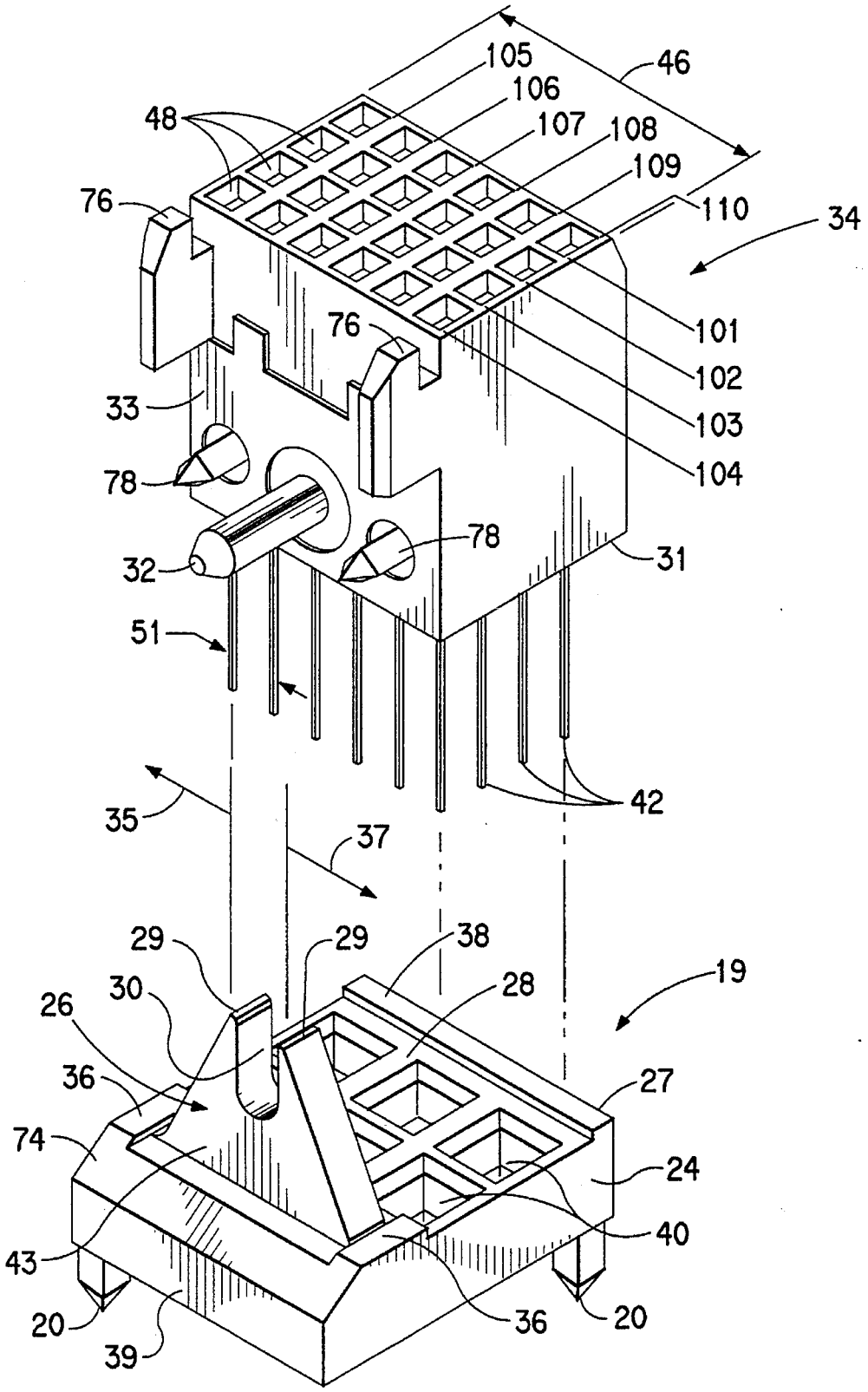
FIG. 2 is a perspective view of a connector assembly of vertical female connector or receptacle and a connector wafer exploded from each other, shown with a first side of an insulative block of the connector wafer.
Figure 3:
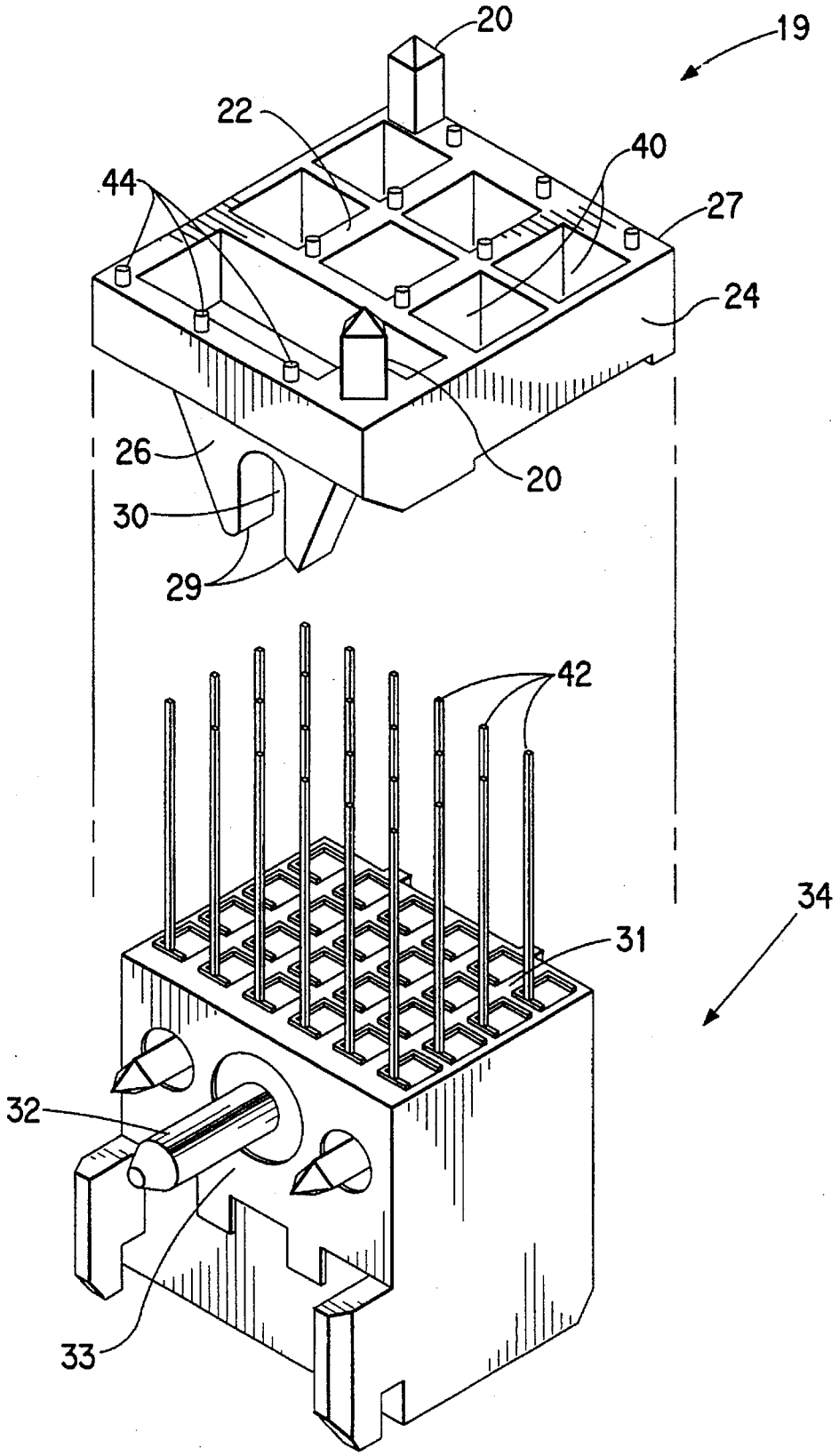
FIG. 3 is a perspective view of a connector assembly of the vertical female connector or receptacle and a connector wafer exploded from each other, showing a second side of the insulative block of the connector wafer.

Referring to FIGS. 2 and 3, this invention relates in one aspect to a connector wafer 19 with an insulative block 24 having a first side 28 and a second side 22 for interconnecting a vertical female connector or receptacle 34 to a printed circuit board. FIG. 2 is a perspective view of a connector assembly of the vertical female connector or receptacle 34 and the connector wafer 19 exploded from each other, shown with a first side 28 of the insulative block 24 of the connector wafer 19 facing a mating side 31 of the vertical female connector or receptacle 34.

FIG. 3 is a perspective view of the connector assembly of the vertical female connector or receptacle and the connector wafer 19 exploded from each other, showing a second side of the block 24. The first side of the insulative block 24 of the connector wafer 19 mates with the mating side 31 of the vertical female connector or receptacle 34.

The connector wafer 19 has at least two locating pins 20 extending from the second side 22 of the insulative block 24 for an interference fit in holes through the printed circuit board, the locating pins 20 located on diagonal corners of the second side 22. Preferably, each pin 20 comprises a four-sided obelisk-shaped locating peg.

The connector wafer 19 further has an attachment fork 26 extending from the first side 28 of the insulative block 24, the fork 26 having a slot 30 for receiving a heat staking peg 32 on a wafer-connecting side 33 of the vertical female connector or receptacle 34 and for aligning the female connector receptacle 34 on the insulative block 24. By aligning is meant the positioning of the vertical female receptacle or connector 34 onto the connector wafer 19 with the heat staking peg 32 located within the slot 30 of the connector wafer 19 so that the the vertical female connector or receptacle 34 is confined in movement in a first direction 35 and second direction 37, by prongs 29 of the attachment fork 26 the directions 35 and 37 perpendicular to the prongs 29. The attachment fork 26 is located on the first side 28 at a length from and parallel with the third side 39 of the insulative block 24, the prongs 29 perpendicular to the first side 28 and parallel with the third side 39. The two prongs 29 extend from a base 43, the base 43 extending from the first side 28 of the insulative block 24. Preferably the prongs 29 are tapered at an acute angle extending from the base 43.

Figure 4:
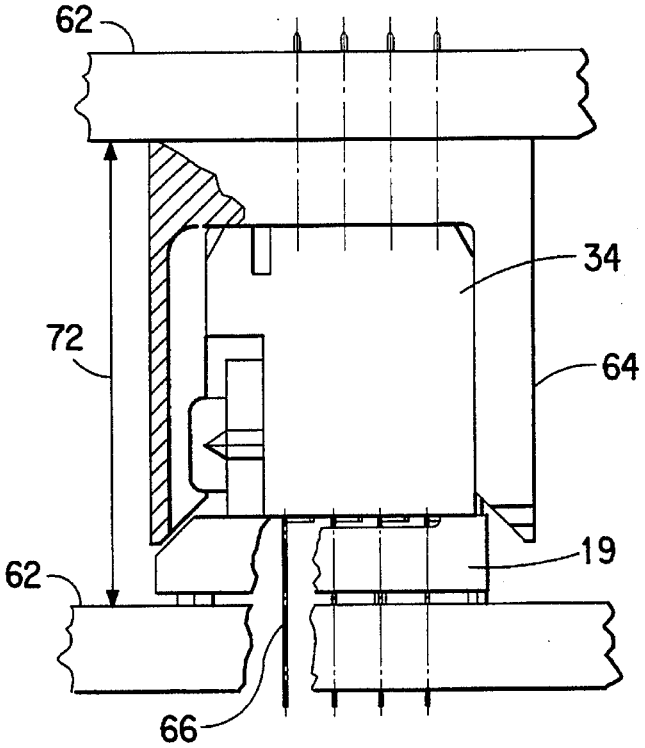
FIG. 4 is a side view of an assembly having two parallel printed circuit boards connected by a wide body header and the vertical female connector or receptacle, the vertical female receptacle shown interconnected to one of the printed circuit boards by the insulative block of the connector wafer with a break-out section of one of the connections showing a straight-through pin connection between the female receptacle and the printed circuit board.

Preferably, the insulative block 24 has a beveled surface 74 extending from the first side 28 of the insulative block 24 for aligning with a wide body header 64 of FIG. 4. The beveled surface 74 is directed at a non-orthogonal angle with respect to the third side 39 and connects a third side 35 of the insulative block 24 to steps 36 extending from the insulative block 24.

These two (2) fork-end steps 36 extend from an area of the first side 28 of the insulative block 24 for contacting the mating opposing side of the vertical female connector or receptacle 34, the steps 36 partially defining the first side 28 of the insulative block 24. The fork-end steps 36 are positioned on either side of the prongs 29 of the attachment fork 26. In addition, the insulative block 24 has a third step 38, extending from the first side 28 for contacting the mating opposing side 31 of the vertical female connector or receptacle 34 and partially forming a fourth side 27 of the insulative block 24. Preferably, the two fork-end steps 36 and the third step 38 are rectangular-shaped.

Furthermore, the connector wafer 19 has passages 40 extending from the first side 28 to the second side 22 of the insulative block 24 through the insulative block 24, each passage 40 for receiving at least one terminal tail 42 to extend therethrough to allow for non-contacting extension of the terminal tails 42 through the passages 40. Preferably, each passage receives at least two, and especially preferably, four (4) terminal tails, the passages having square or rectangular cross sections.

Referring to FIG. 3, the connector wafer 19 further has standoffs 44 extending from the second side 22 of the insulative block 24 for contacting a printed circuit board and providing a space between the printed circuit board and the insulative block 24 for cleaning purposes. Preferably the standoffs 44 extend for about 0.5 mm above the surface of the second side 22.

Figure 5:
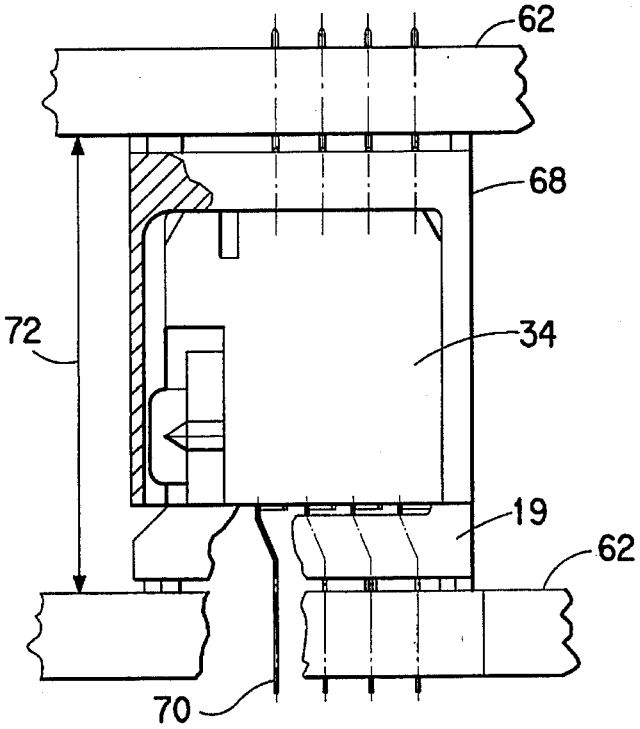
FIG. 5 is an side view of an assembly having two parallel printed circuit boards connected by a narrow body header and the vertical female receptacle, the vertical female receptacle shown interconnected to one of the printed circuit boards by the insulative block of the connector wafer with a break-out section of one of the connections showing a dog-leg connection between the female receptacle and the printed circuit board.

Referring to FIGS. 4 and 5, METRAL™ male connectors or headers having a plurality of terminal tails as described in the DuPont Connector Systems Product Catalog A, February 1992, Chapter 10. (E. I. du Pont de Nemours and Company) are available in a wide body type 64, which provide for a press fit of the terminal tails of the header into a printed circuit board and a narrow body type 68, in which the terminal tails of the header are soldered to a printed circuit board. The connector wafer 19 of the present invention can be utilized with either of the two types of METRAL™ header connectors.

FIG. 4 is a side view of an assembly having two parallel printed circuit boards 62 connected by a METRAL™ wide body header 64 and a vertical female connector or receptacle 34, the vertical female connector or receptacle 34 shown interconnected to one of the printed circuit boards 62 by the connector wafer 19 of the invention with a break-out section of one of the connections showing a straight-through pin 66 connection between the vertical female connector or receptacle 34 and the printed circuit board 62.

FIG. 5 is a side view of an assembly having two parallel printed circuit boards 62 connected by a METRAL™ narrow body header 68 and a vertical female connector or receptacle 34, the vertical female connector or receptacle 34 shown interconnected to one of the printed circuit boards 62 by the connector wafer 19 of the invention with a break-out section of one of the connections showing a dog-leg connection 70 between the vertical female connector or receptacle 34 and the printed circuit board 62 for aligning the terminal connections 63 between the two printed circuit boards 62.

An important feature of the connector wafer 19 of the present invention is its use with vertical female connectors or receptacles 34 to interconnect parallel printed circuit boards 62 while maintaining a particular spacing, such as a 20 mm spacing 72 in FIGS. 4 and 5, between the printed circuit boards 62. For one application in interconnecting vertical female connectors or receptacles with printed circuit boards for use with the METRAL™ system, a 20 millimeter (mm) spacing 72 (FIG. 4 and 5) between parallel printed circuit board assemblies is desired.

Figure 1:
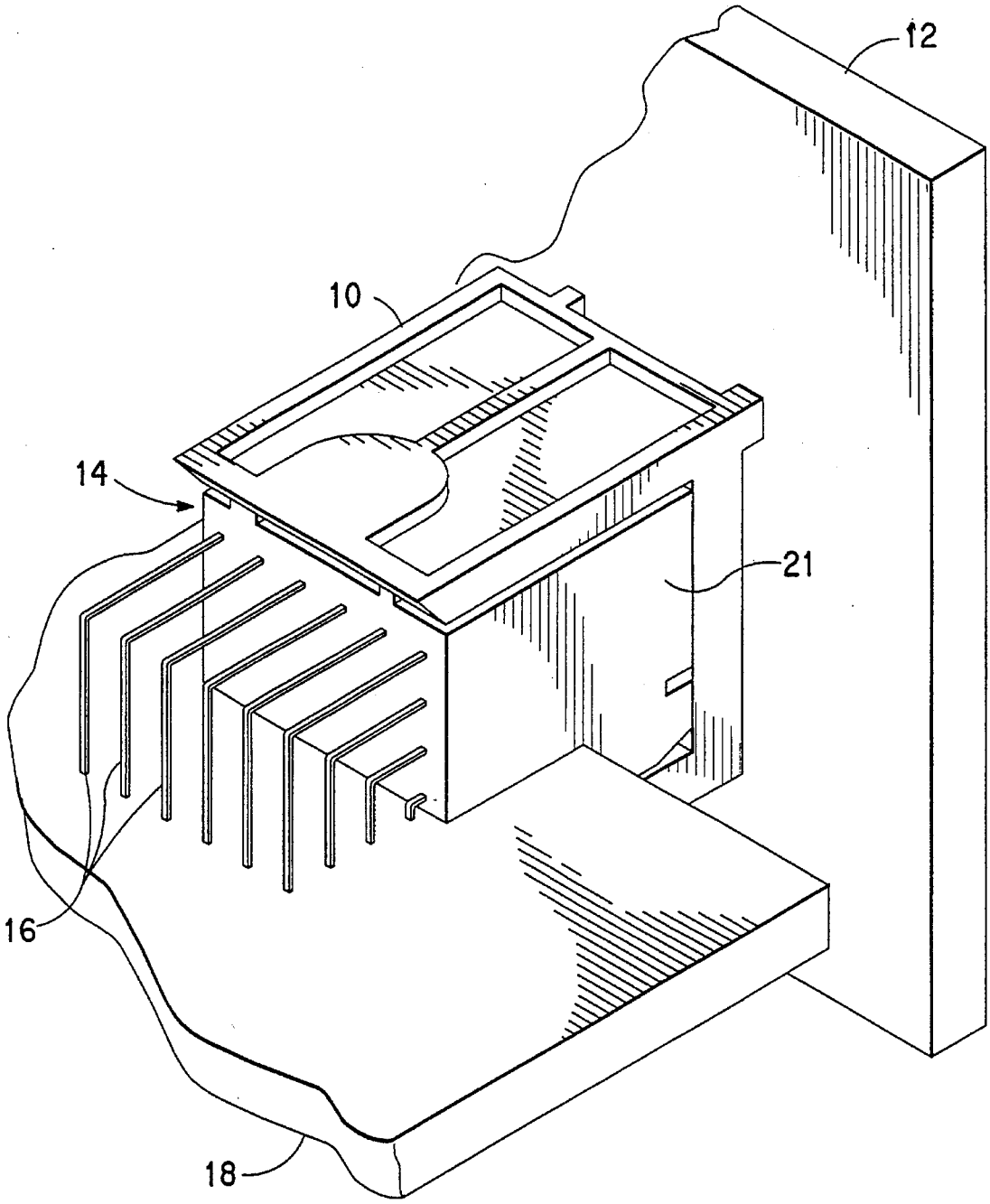
FIG. 1 (PRIOR ART)
FIG. 1 is a perspective view of a METRAL™ assembly having a male connector or header mounted on a backplane printed circuit board, a right angle female connector or receptacle connected to the male connector or header and having terminal tails, the right angle female connector or receptacle mounted on a daughter printed circuit board.

Referring to FIG. 2, the connector wafer 19 can be provided in modularized lengths corresponding with a modularized length 46, such as 12 mm or a multiple thereof, or any other length of vertical female connectors or receptacles 34. The vertical female connector or receptacle 34 can be produced using the existing METRAL™ right angle female connector or receptacle housing 21 (FIG. 1).

The vertical female connector or receptacle 34 has a plurality of electrically conductive contact elements 48 arranged in at least four (4) rows 101 through 104, and a plurality of columns 105 through 110, the pitch 51 between the centerline of pairs of the contact elements in the rows 101 through 104, and columns 105 through 110, being of a particular distance, such as 2 mm. In order to conform with existing METRAL™ right angle female connector or receptacles 14 (FIG. 1) a length 46 of 12 mm and a pitch 51 between the centerline of pairs of the contact elements in the rows 101 through 104, and columns 105 through 110, of 2 mm is preferred. The vertical female connector or receptacle 34 further has two locating pins 78 (part of existing METRAL™ right angle female receptacle housing but serving no purpose in the vertical female receptacle) and two (2) ski-noses 76 for attaching to the male header.

The connector wafer 19 corresponding to the existing METRAL™ female connector housing of a length of 12 mm has six (6) passages 40, three (3) passages 40 corresponding to the six columns 105 through 110, and two (2) passages 40 corresponding to the four rows 101 through 104, of the vertical female connector or receptacle 34, with each passage 40 for receiving four (4) terminal tails 42.

Other modularized connector wafers and assemblies of vertical female connectors or receptacles and modularized connector wafers can be prepared as shown, for example, in FIGS. 6, 7, 8A and 8B.

Figure 6:
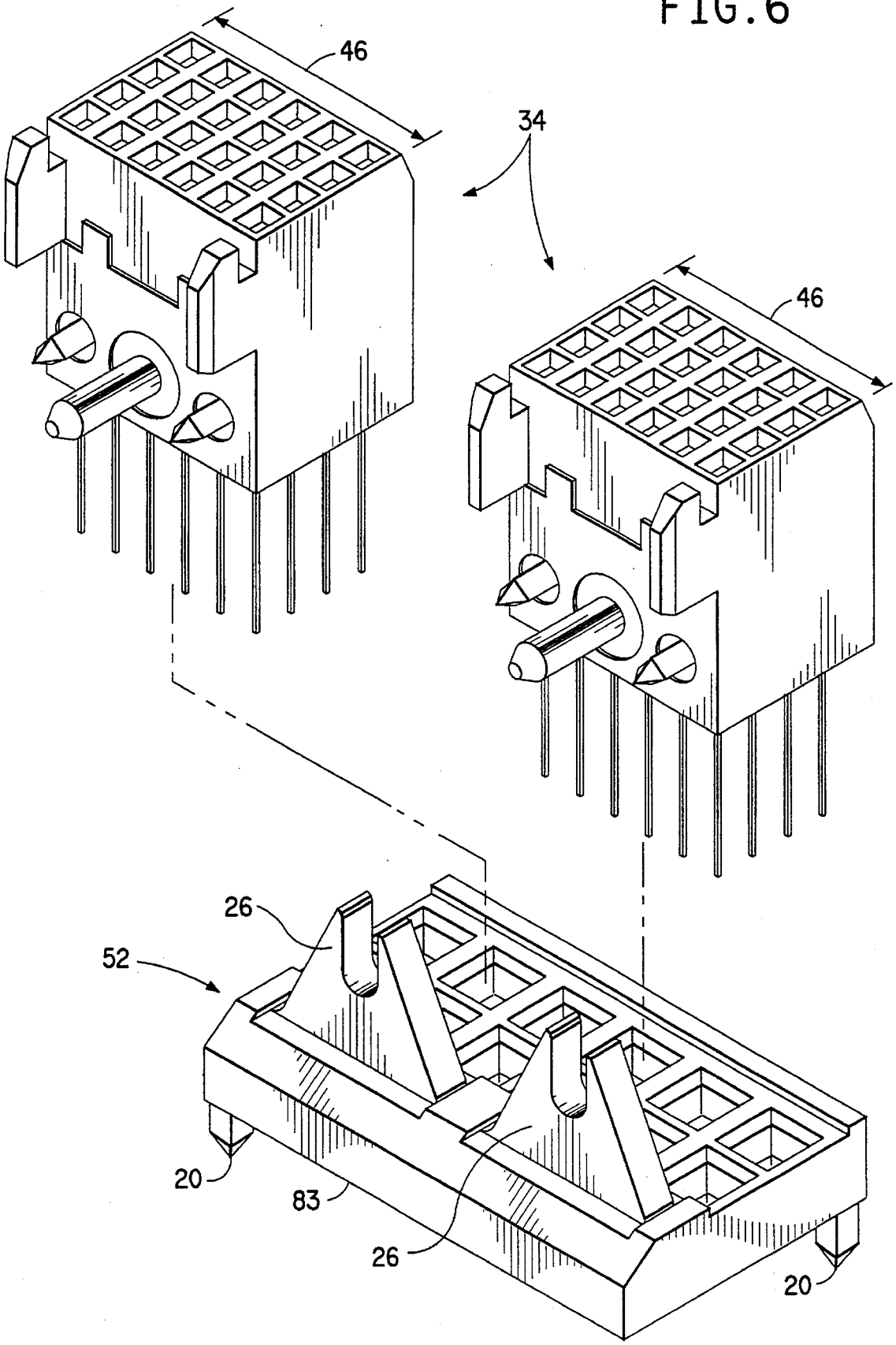
FIG. 6 is a perspective view of a connector assembly having two (2) vertical female connectors or receptacles and a single connector wafer exploded from each other.

The present invention is further directed to connector assemblies comprising a plurality of vertical receptacles 34 and a single connector wafer 52. FIG. 6 illustrates one such assembly.

FIG. 6 is a perspective view of a connector assembly having two (2) female connectors 34 and the single connector wafer 52 exploded from each other. The connector wafer 52 can be used with two (2) vertical female connectors or receptacles 34 each having a length 46 of 12 mm, and has twelve (12) passages 40 with each passage 40 for receiving four (4) terminal tails 42. The connector wafer 52 has two (2) fork attachments 26 and two (2) locating pegs 20 located on diagonal corners of a second side 83 of the connector wafer 52.

Figure 7:
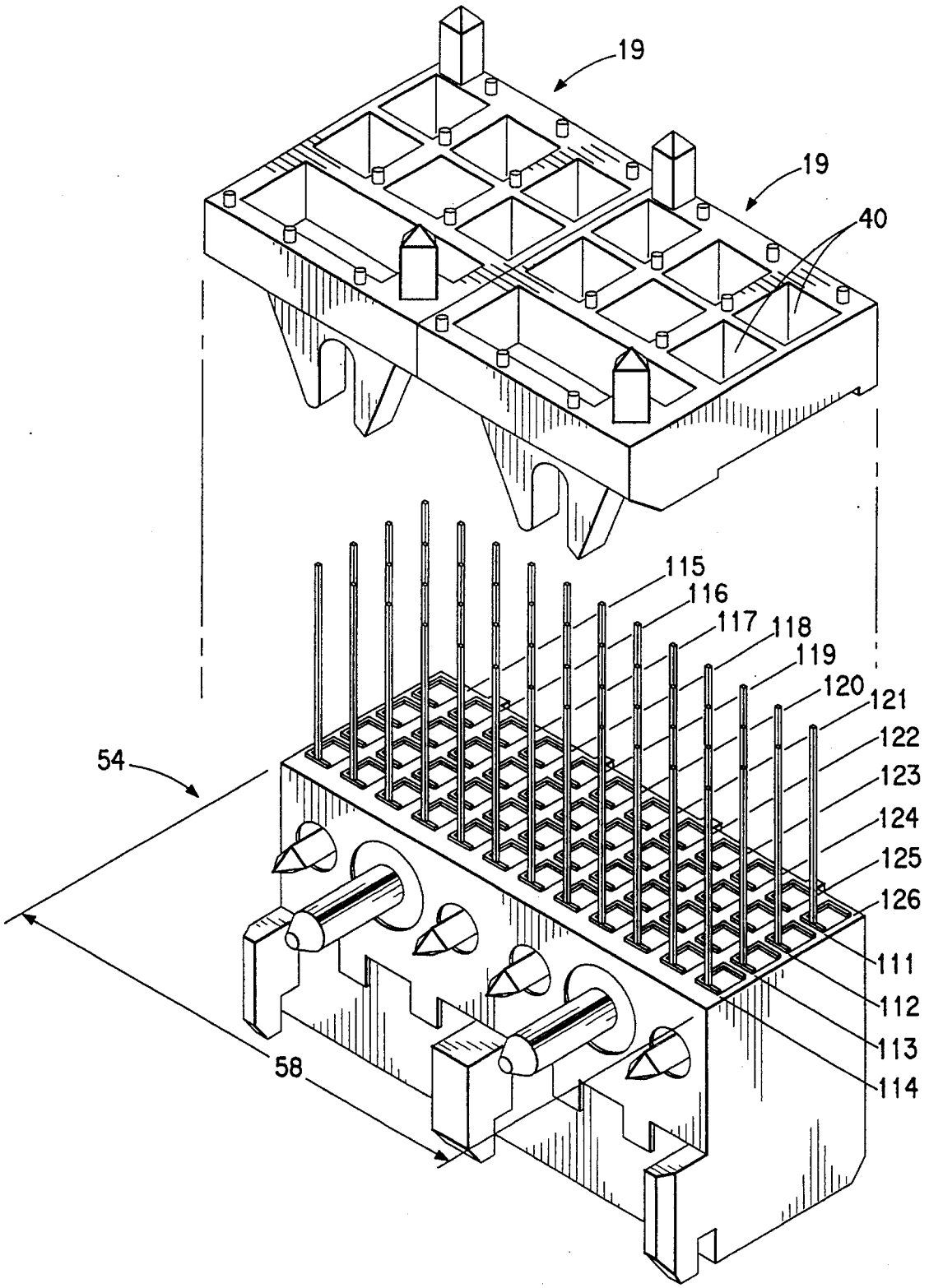
FIG. 7 is a perspective view of a connector assembly having a single vertical female connector or receptacle and two (2) connector wafers exploded from each other.

The present invention is further directed to connector assemblies comprising a single vertical female connector or receptacle 54 and a plurality of connector wafers 19. FIG. 7 illustrates one such connector assembly. FIG. 7 is a perspective view of a connector assembly having the single vertical female connector 54 having a length 58 of 24 mm and two (2) connector wafers 19. The vertical female connector or receptacle 54 has four (4) rows, 111 through 114, and twelve (12) columns 115 through 126, and a total of 48 terminal tails 42 The two connector wafers 19 each has six (6) passages 40 for receiving one-half or twenty-four (24) of the terminal tails 42 of the vertical female connector or receptacle 54.

The present invention is further directed to connector assemblies comprising a plurality of vertical female connectors or receptacles 34, 54 and a plurality of connector wafers 52.

Figure 8:
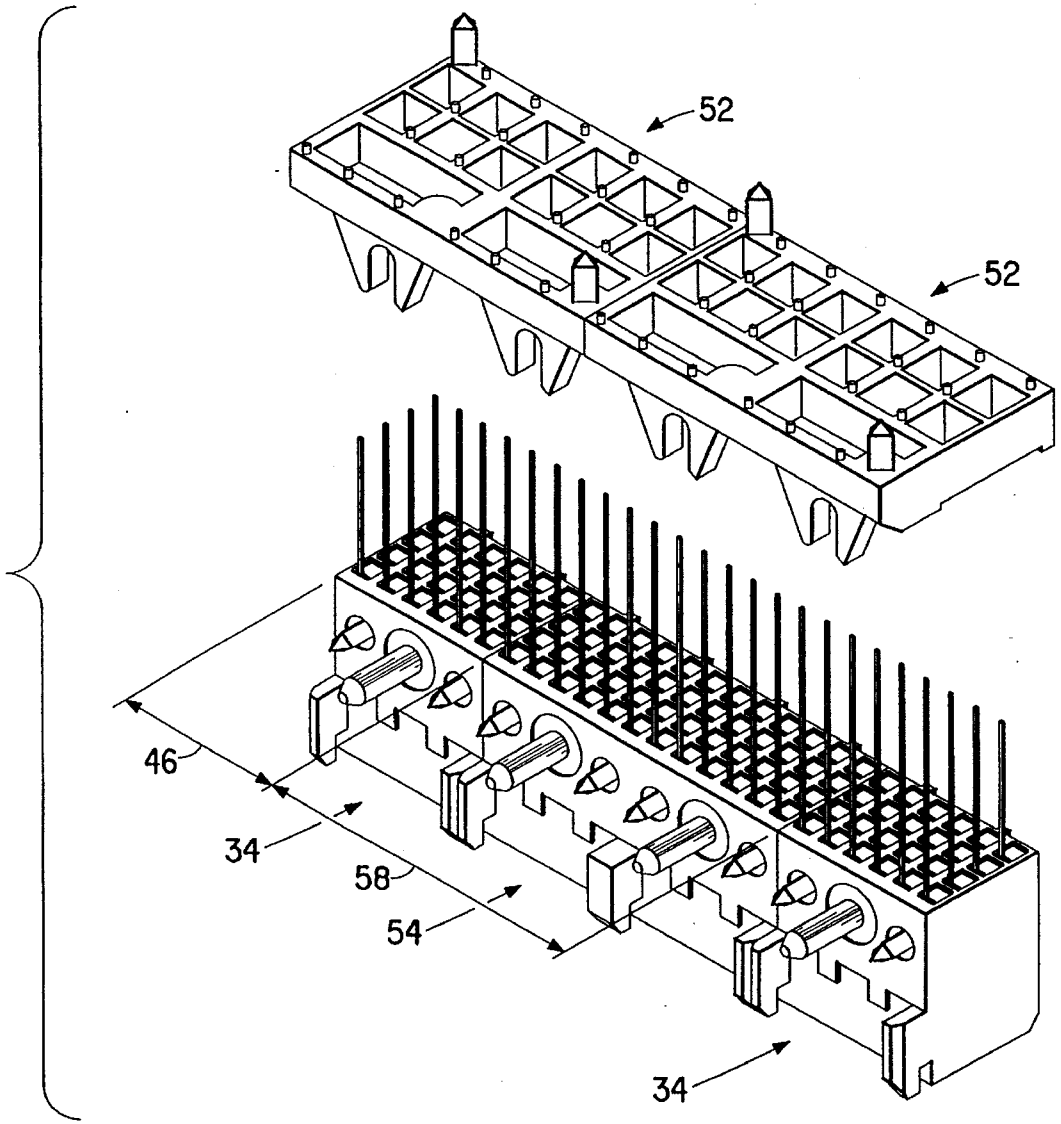
FIG. 8 is a perspective view of a connector assembly having three (3) female connectors and two (2) connector wafers exploded from each other.

FIG. 8 is a perspective view of two connector wafers 52 which are part of a connector assembly with three (3) vertical female connectors or receptacles 34, 34, and 54, two of the vertical female connectors or receptacles 34 having a standard length 46 of 12 mm and the remaining vertical female connector or receptacle 54 having a length 58 of 24 mm.

Thus the connector wafer of the present invention provides for the interconnecting of a METRAL™ vertical female connector or receptacle 34 to a printed circuit board 62 while maintaining the above mentioned METRAL™ connector products 20 mm spacing between connected printed circuit boards 62.

What is claimed is:

1. A connector wafer for interconnecting a vertical receptacle to a circuit board, comprising:

an insulative block having a first side and a second side;

a first set of two locating pins extending from the second side for interference fit in holes through the circuit board;

an attachment fork extending from the first side, the fork having a slot for receiving another locating pin on the receptacle and for aligning the receptacle on the insulative block;

steps extending from the first side for contacting a mating opposing side of the receptacle;

passages extending through the block, each passage for receiving at least two terminal tails to extend therethrough to allow for non-contacting extension of the terminal tails through the passages; and standoffs extending from the second side for contacting the circuit board and providing a space between the circuit board and the insulative block for cleaning purposes.

2. The connector wafer of claim 1, wherein the first side of the insulative block has a beveled surface for aligning with a wide body header.

3. The connector wafer of claim 1, wherein each passage receives four terminal tails, the passages having rectangular cross sections.

4. The connector wafer of claim 1 wherein there are three steps.

5. The connector wafer of claim 1, wherein the first set of locating pins are obelisk shaped.

6. A connector assembly for interconnecting parallel printed circuit boards which comprises:

a vertical female receptacle comprising an insulative housing having a mating opposing side, an attachment side with a locating pin, passages extending through the insulative housing and terminals in the passages with terminal portions extending from the mating opposing side, the terminals having tails, and a connector wafer comprising an insulative block with a first side and a second side, locating pins extending from the second side for interference fit in holes through one of the printed circuit boards, an attachment fork extending from the first side, the fork having a slot for receiving the receptacle locating pin and for aligning the receptacle on the insulative block, steps extending from the first side for contacting the mating opposing side of the receptacle, passages extending through the block, each passage for receiving at least two of the terminal tails to extend therethrough to allow for non-contacting extension of the terminal tails through the passages, and standoffs extending from the second side for contacting the printed circuit board and providing a space between the printed circuit board and the insulative block for cleaning purposes.

7. The connector assembly of claim 6, the receptacle further comprising a second locating pin on the attachment side and a second one of the connector wafers, the fork slot of the second wafer for receiving the second locating pin.

8. The connector assembly of claim 6, the connector wafer further comprising a second fork slot extending from the first side and a second one of the receptacles, the second fork slot for receiving the locating pin of the second receptacle.

9. The connector assembly of claim 6, the connector wafer further comprising a second fork slot extending from the first side, a second one of the receptacles, the second fork slot of the connector wafer for receiving the locating pin on the second receptacle, the second receptacle further comprising a second locating pin on the attachment side, a second one of the connector wafers, the fork slot of the second connector wafer for receiving the second locating pin of the second receptacle, the second connector wafer further comprising a second fork slot extending from the first side of the second connector wafer, a third one of the receptacles, the second fork slot of the second wafer for receiving the locating pin of the third receptacle.

10. An electrical connector assembly for connecting circuit boards, said connector assembly comprising:

a male connector located on a first circuit board having a connecting terminal;

a vertical female receptacle associated with a second circuit board having a first wall and a second wall, said first wall having a locator for anchoring said vertical female receptacle at predetermined orientations with respect to said second circuit board, said second wall accepting said connecting terminal; and a connector wafer located between said second circuit board and said vertical female receptacle for positioning said vertical female receptacle at one of said predetermined orientations so as to adapt said vertical female receptacle to connect to said first circuit board in parallel to said second circuit board, said connector wafer having a locator receiving portion projected vertically from said connector wafer for receiving said locator, said connector wafer being positioned inside said male connector when said first circuit board is connected in parallel to said second circuit board.

11. The electrical connector assembly of claim 10 wherein said locator is a positioning pin.

12. The electrical connector assembly of claim 11 wherein said locator receiving portion is at least an attachment fork for accepting said positioning pin so as to position said vertical female receptacle in a predetermined position with respect to said connector wafer.

13. The electrical connector assembly of claim 12 wherein said positioning pin is deformed to fixedly engage said attachment fork.

14. The electrical connector assembly of claim 10 wherein said connector wafer further comprises male-connector positioning means for positioning said male connector with respect to said female receptacle, locating means located between one of said second set of circuit boards and said connector wafer for positioning said connector wafer with respect to said one of said second set of circuit boards, and standoffs located between said one of said second set of circuit boards and said connector wafer for maintaining a predetermined space between said one of said second set of circuit boards and said connector wafer.

15. The electrical connector assembly of claim 14 wherein said male-connector positioning means further comprises:

steps located on an opposing surface of said connector wafer for engaging said male connector, and a beveled surface located on an opposing surface of said connector wafer for accepting said male connector.

16. An adaptable connector assembly system for connecting circuit board in different orientation, comprising:

a first circuit board;

a second circuit board;

an adaptable circuit board connector capable of connecting said first circuit board and said second circuit board at one orientation selected from the group consisting of vertical orientation and parallel orientation; and an adaptor located between said first circuit board and said second circuit board for holding said adaptable circuit board connector at a predetermined orientation with respect to said first circuit board so as to allow connection between said first circuit board and said second circuit board positioned in parallel, said adaptor being positioned inside said adaptable circuit board connector.

* * * * *